US011434454B2

(12) United States Patent
Pechera et al.

(10) Patent No.: US 11,434,454 B2
(45) Date of Patent: Sep. 6, 2022

(54) LAUNDRY DETERGENT COMPOSITION

(71) Applicant: Church & Dwight Co., Inc., Princeton, NJ (US)

(72) Inventors: Leilani Pechera, Kendall Park, NJ (US); Vaidehi Shah, Manalapan, NJ (US); Archana Gupta, Belle Mead, NJ (US); Steven Adamy, Lawrenceville, NJ (US)

(73) Assignee: Church & Dwight Co., Inc., Princeton, NJ (US)

( * ) Notice: Subject to any disclaimer, the term of this patent is extended or adjusted under 35 U.S.C. 154(b) by 0 days.

(21) Appl. No.: 16/955,199

(22) PCT Filed: Dec. 19, 2018

(86) PCT No.: PCT/IB2018/060388
§ 371 (c)(1),
(2) Date: Jun. 18, 2020

(87) PCT Pub. No.: WO2019/123343
PCT Pub. Date: Jun. 27, 2019

(65) Prior Publication Data

US 2021/0179981 A1 Jun. 17, 2021

Related U.S. Application Data

(60) Provisional application No. 62/610,024, filed on Dec. 22, 2017.

(51) Int. Cl.

| | |
|---|---|
| ***C11D 17/04*** | (2006.01) |
| ***C11D 3/04*** | (2006.01) |
| ***C11D 3/10*** | (2006.01) |
| ***C11D 17/00*** | (2006.01) |

(52) U.S. Cl.
CPC ..... *C11D 17/043* (2013.01); *C11D 3/046* (2013.01); *C11D 3/10* (2013.01); *C11D 17/0026* (2013.01)

(58) Field of Classification Search
None
See application file for complete search history.

(56) References Cited

U.S. PATENT DOCUMENTS

| | | | | |
|---|---|---|---|---|
| 4,142,999 | A | 3/1979 | Blocking et al. | |
| 4,530,780 | A | 7/1985 | van de Pas et al. | |
| 4,886,615 | A | 12/1989 | Dehan | |
| 4,959,179 | A | 9/1990 | Aronson et al. | |
| 4,973,416 | A | 11/1990 | Kennedy | |
| 5,691,292 | A | 11/1997 | Marshall et al. | |
| H1776 | H | 1/1999 | Linard et al. | |
| 6,177,396 | B1 | 1/2001 | Clapperton et al. | |
| 6,387,864 | B1 | 5/2002 | Bartelme | |
| 6,521,581 | B1 | 2/2003 | Hsu et al. | |
| 6,898,921 | B2 | 5/2005 | Duffield | |
| 6,936,578 | B2 | 8/2005 | Cordellina et al. | |
| 7,056,876 | B2 | 6/2006 | Shamayeli | |
| 7,196,044 | B2 * | 3/2007 | Smith | C11D 3/0073 510/439 |
| 7,915,213 | B2 | 3/2011 | Adamy et al. | |
| 8,669,220 | B2 | 3/2014 | Huber et al. | |
| 9,187,714 | B2 | 11/2015 | Schmiedel et al. | |
| 2002/0033004 | A1 | 3/2002 | Edwards et al. | |
| 2004/0204336 | A1 * | 10/2004 | Himmrich | C11D 1/65 510/504 |
| 2006/0281658 | A1 | 12/2006 | Kellar et al. | |
| 2007/0157572 | A1 | 7/2007 | Oehms et al. | |
| 2012/0097193 | A1 | 4/2012 | Rossetto et al. | |
| 2014/0243253 | A1 | 8/2014 | Schmiedel et al. | |
| 2015/0299624 | A1 | 10/2015 | Himmrich et al. | |
| 2015/0329803 | A1 | 11/2015 | Caires et al. | |

(Continued)

FOREIGN PATENT DOCUMENTS

| | | |
|---|---|---|
| CA | 1112534 | 11/1981 |
| EP | 158464 | 10/1985 |
| EP | 234867 | 9/1987 |
| EP | 0608825 A1 | 8/1994 |
| GB | 1181581 A | 2/1970 |
| JP | 61-151029 | 6/1986 |
| JP | 61-151032 | 6/1986 |
| JP | 2004059886 | 2/2014 |

(Continued)

OTHER PUBLICATIONS

Lund, et al., "Correlation Between Enzyme Activity and Stability of a Protease,an Alpha-Amylase and a Lipase in a Simplified Liquid Laundry Detergent System, Determined by Differential Scanning Calorimetry", J Surfact Deterg (2012) vol. 15, pp. 9-21, Published online May 5, 2011. US.

Rothgeb, et al., "The Raw Material, Finished Products and Dust Pad Analysis of Detergent Proteases Using A Small Synthetic Substrate", Surfactants & Detergents Technical, JAOCS, vol. 55, No. 5, pp. 806-810 (May 1988). US.

*Primary Examiner* — Lorna M Douyon
(74) *Attorney, Agent, or Firm* — Church & Dwight Co., Inc.

(57) ABSTRACT

An article is provided herein which includes a shear-thinning, non-thixotropic aqueous liquid detergent and a package for the aqueous liquid detergent which is in direct contact with the aqueous liquid detergent, wherein the package is formed from a water-soluble, film-forming material. The aqueous liquid detergent includes at least about 25% by weight of water based on the total weight of the aqueous liquid detergent, a builder comprising potassium carbonate, and a chloride salt, wherein the builder and the chloride salt are present in a combined total amount of about 25% to about 50% percent by weight based on the total weight of the aqueous liquid detergent, and the builder and the chloride salt are present in a weight ratio of about 99:1 to about 75:25. Methods of preparing the aqueous liquid detergent and the article are also provided herein.

6 Claims, 1 Drawing Sheet

(56) References Cited

U.S. PATENT DOCUMENTS

| | | | | |
|---|---|---|---|---|
| 2015/0329807 | A1* | 11/2015 | Naqvi | C11D 3/2003 206/524.7 |
| 2015/0337236 | A1* | 11/2015 | Tang | C11D 1/22 510/342 |
| 2016/0136888 | A1 | 5/2016 | Bayley et al. | |
| 2016/0244701 | A1* | 8/2016 | Backer | C11D 17/045 |
| 2017/0292090 | A1* | 10/2017 | Karikari | C11D 3/046 |
| 2018/0216034 | A1* | 8/2018 | Camire | C11D 1/831 |
| 2018/0334641 | A1* | 11/2018 | Piorkowski | C11D 1/65 |
| 2019/0062673 | A1* | 2/2019 | Klemmer | C11D 3/046 |

FOREIGN PATENT DOCUMENTS

| | | |
|---|---|---|
| WO | 2002016541 | 2/2002 |
| WO | 2003/006594 | 1/2003 |
| WO | 2015/099729 | 7/2015 |
| WO | 2015/132279 | 9/2015 |

* cited by examiner

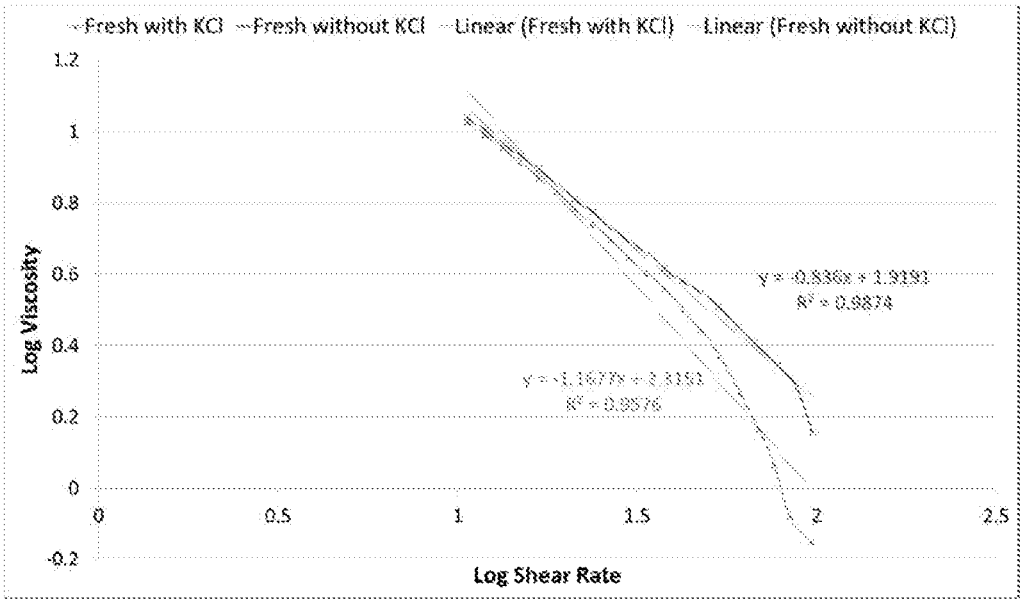
Fresh with KCl
Fresh without KCl
Linear (Fresh with KCl)
Linear (Fresh without KCl)
1.2
1
0.8
0.6
0.4
0.2
0
-0.2
Log Viscosity
0
0.5
1
1.5
2
2.5
Log Shear Rate
y = -0.536x + 1.9191
R² = 0.9874
y = -1.1677x + 2.3191
R² = 0.9576

LAUNDRY DETERGENT COMPOSITION

FIELD OF THE INVENTION

The present invention relates to compositions for use in laundry machines, and more particularly to an aqueous liquid detergent composition.

BACKGROUND

This invention relates to high water content liquid laundry detergents in unit dosage form in a package comprising a water-soluble, film-forming material.

The use of water-soluble film packages to deliver unit dosage amounts of laundry products is well known. Granular detergents and granular bleaches have been sold in this form in the United States for many years. A compact granular detergent composition in a water-soluble film pouch has been described in Japanese Patent Application No. 61-151032, filed Jun. 27, 1986, which is incorporated herein by reference. A paste detergent composition packaged in a water-soluble film is disclosed in Japanese Patent Application No. 61-151029, also filed Jun. 27, 1986. Further disclosures relating to detergent compositions which are either pastes, gels, slurries, or mulls packaged in water-soluble films can be found in U.S. Pat. No. 8,669,220 to Huber et al.; U.S. Pat. App. Pub. Nos. 2002/0033004 to Edwards et al., 2007/0157572 to Oehms et al., and 2012/0097193 to Rossetto et al.; Canadian Patent No. 1,112,534 issued Nov. 17, 1981; and European Patent Application Nos. 158464 published Oct. 16, 1985 and 234867, published Sep. 2, 1987; each of which is incorporated herein by reference. A liquid laundry detergent containing detergents in a water/propylene glycol solution is disclosed in U.S. Pat. No. 4,973,416, which is herein incorporated by reference. See, also, U.S. Pat. No. 7,915,213 to Adamy et al. and U.S. Pat. App. Pub. No. 2006/0281658 to Kellar et al., which disclose high builder compositions in pods and are both herein incorporated by reference.

It is generally believed that high water content liquid laundry detergents are incompatible with water-soluble films because of their water content. Thus, the attendant advantages of high water content liquid laundry detergents over other forms of laundry detergents such as granules, pastes, gels, and mulls have not been readily available in water-soluble unit dosage form. The advantages of liquid laundry detergents over granules, pastes, gels, and mulls include their aesthetic appearance and the faster delivery and dispersibility of the detergent ingredients to the laundry wash liquor, especially in a cool or cold water washing process.

The use of a water-soluble alkaline carbonate builder in the detergent composition can help prevent the aqueous detergent composition from dissolving the water-soluble package material. Laundry detergent compositions comprising a water-soluble alkaline carbonate are well-known in the art. For example, it is conventional to use such a carbonate as a builder in detergent compositions which supplement and enhance the cleaning effect of an active surfactant present in the composition. Such builders improve the cleaning power of the detergent composition, for instance, by the sequestration or precipitation of hardness causing metal ions such as calcium, peptization of soil agglomerates, reduction of the critical micelle concentration, and neutralization of acid soil, as well as by enhancing various properties of the active detergent, such as its stabilization of solid soil suspensions, solubilization of water-insoluble materials, emulsification of soil particles, and foaming and sudsing characteristics. Other mechanisms by which builders improve the cleaning power of detergent compositions are less well understood. Builders are important not only for their effect in improving the cleaning ability of active surfactants in detergent compositions, but also because they allow for a reduction in the amount of the surfactant used in the composition, the surfactant being generally much more costly than the builder.

Sodium carbonate ($Na_2CO_3$) and/or potassium carbonate ($K_2CO_3$) are the most common carbonates included in laundry detergents to impart increased alkalinity to wash loads, thereby improving detergency against many types of soils. In particular, soils having acidic components e.g. sebum and other fatty acid soils, respond especially well to increased alkalinity.

While laundry detergents containing a relatively large amount of carbonate builder are generally quite satisfactory in their cleaning ability, the use of such carbonate builders often results in the problem of calcium carbonate precipitation, which may give rise to fabric encrustation due to the deposition of the calcium carbonate on the fiber surfaces of fabrics which in turn causes fabric to have a stiff hand and gives colored fabrics a faded appearance. Thus, any change in available carbonate built laundry detergent compositions which reduces their tendency to cause fabric encrustation is highly desirable.

In many applications, it is desirable to include $Na_2CO_3$ and $K_2CO_3$ in detergent formulations at levels greater than 20%. This is readily achieved in the case of a powdered detergent. However, incorporating such large amounts into an aqueous liquid is much more difficult. In liquid laundry detergent compositions, the incorporation of a large amount of detergent builder poses a significant formulation challenge since the presence of a major quantity of detergent builder inevitably causes the detergent composition to phase separate. Liquid detergent formulations that contain a detergent builder ingredient require careful control of the surfactant to builder ratio so as to prevent salting-out of the surfactant phase. Liquid laundry detergent compositions are also susceptible to instability under extended freeze/thaw and high/low temperature conditions.

Additionally, sodium carbonate forms an extensive array of low water soluble hydrates at low temperatures and high, i.e., >15 wt. % levels of the sodium carbonate builder. For example, a system with 20% carbonate builder will form a decahydrate phase below 23° C. At 30% sodium carbonate, the decahydrate will form below 31° C. Therefore, even at room temperature, systems containing greater than 20% carbonate builder are inherently unstable and readily form decahydrate phases. Once the decahydrate forms, redissolution can take an inordinate amount of time.

Accordingly, there is still a desire and a need to provide a stable liquid laundry detergent that is still suitable for use in forming dose packs or pods with a water-soluble, film-forming material, which is in direct contact with the liquid laundry detergent.

SUMMARY OF THE INVENTION

In one aspect of the present invention, an aqueous liquid detergent is provided. An article is also provided herein, the article comprising a shear-thinning, non-thixotropic aqueous liquid detergent and a package for the aqueous liquid detergent which is in direct contact with the aqueous liquid detergent, wherein the package is formed from a water-soluble, film-forming material. In various embodiments, the water-soluble, film-forming material is polyvinyl alcohol.

The aqueous liquid detergent can include at least about 25% by weight of water based on the total weight of the aqueous liquid detergent, a builder comprising potassium carbonate, and a chloride salt. In certain embodiments, the chloride salt can be potassium chloride. In some embodiments, the chloride salt can be present in an amount of about 0.1% to about 5% by weight based on the total weight of the aqueous liquid detergent. In various embodiments, the water can be present in an amount of about 25 to about 45 weight percent, based on the total weight of the aqueous liquid detergent.

The builder and the chloride salt can be present in a combined total amount of about 25% to about 50% percent by weight, or about 30% to about 38% by weight, based on the total weight of the aqueous liquid detergent. In some embodiments, the builder and the chloride salt can be present in a weight ratio of about 99:1 to about 75:25, or in a weight ratio of about 98:2 to about 85:15. In various embodiments, the aqueous liquid detergent can further comprise a surfactant.

A method of preparing a shear-thinning, non-thixotropic aqueous liquid detergent is also provided herein. In various embodiments, the method of preparing the detergent composition can comprise mixing one or more surfactants and a chloride salt in an aqueous liquid medium to form a first mixture, and adding a builder comprising potassium carbonate to the first mixture to form the aqueous liquid detergent as a substantially homogeneous solution. The substantially homogeneous solution forms without the intermediate formation of a gel phase.

A method of preparing a detergent article is also provided herein. In various embodiments of the present invention, the method of preparing a detergent article can comprise mixing one or more surfactants and a chloride salt in an aqueous liquid medium to form a first mixture, adding a builder comprising potassium carbonate to the first mixture to form the aqueous liquid detergent as a substantially homogeneous solution, placing a measured amount of the aqueous liquid detergent into a package for the aqueous liquid detergent which is in direct contact with the aqueous liquid detergent, and heat sealing the water-soluble, film forming material of the package. The package can be formed from a water-soluble, film-forming material, and the film-forming material is insoluble with respect to the aqueous liquid detergent contained within the package.

The invention includes, without limitation, the following embodiments:

Embodiment 1: An article comprising: (i) a shear-thinning, non-thixotropic aqueous liquid detergent comprising (a) at least about 25% by weight of water based on the total weight of the aqueous liquid detergent, (b) a builder comprising potassium carbonate, and (c) a chloride salt, wherein the builder and the chloride salt are present in a combined total amount of about 25% to about 50% percent by weight based on the total weight of the aqueous liquid detergent, and the builder and the chloride salt are present in a weight ratio of about 99:1 to about 75:25; and (ii) a package for the aqueous liquid detergent which is in direct contact with the aqueous liquid detergent, wherein the package is formed from a water-soluble, film-forming material.

Embodiment 2: An article of any preceding embodiment, wherein the aqueous liquid detergent further comprises a surfactant.

Embodiment 3: An article of any preceding embodiment, wherein the water-soluble film-forming material is polyvinyl alcohol.

Embodiment 4: An article of any preceding embodiment, wherein the chloride salt is potassium chloride.

Embodiment 5: An article of any preceding embodiment, wherein the builder and the chloride salt are present in a combined total amount of about 30% to about 38% by weight based on the total weight of the aqueous liquid detergent.

Embodiment 6: An article of any preceding embodiment, wherein the builder and the chloride salt are present in a weight ratio of about 98:2 to about 85:15.

Embodiment 7: An article of any preceding embodiment, wherein the chloride salt is present in an amount of about 0.1% to about 5% by weight based on the total weight of the aqueous liquid detergent.

Embodiment 8: An article of any preceding embodiment, wherein the water is present in an amount of about 25 to about 45 weight percent, based on the total weight of the aqueous liquid detergent.

Embodiment 9: A shear-thinning, non-thixotropic aqueous liquid detergent comprising: at least about 25% by weight of water based on the total weight of the aqueous liquid detergent; a builder comprising potassium carbonate; and a chloride salt; wherein the builder and the chloride salt are present in a combined total amount of about 25% to about 50% percent by weight based on the total weight of the aqueous liquid detergent, and the builder and the chloride salt are present in a weight ratio of about 99:1 to about 75:25.

Embodiment 10: An aqueous liquid detergent of any preceding embodiment, further comprising a surfactant.

Embodiment 11: An aqueous liquid detergent of any preceding embodiment, wherein the chloride salt is potassium chloride.

Embodiment 12: An aqueous liquid detergent of any preceding embodiment, wherein the builder and the salt are present in a combined total amount of about 30% to about 38% by weight based on the total weight of the aqueous liquid detergent.

Embodiment 13: An aqueous liquid detergent of any preceding embodiment, wherein the builder and the salt are present in a builder:salt weight ratio of about 98:2 to about 85:15.

Embodiment 14: An aqueous liquid detergent of any preceding embodiment, wherein the chloride salt is present in an amount of about 0.1% to about 5% by weight based on the total weight of the aqueous liquid detergent.

Embodiment 15: An aqueous liquid detergent of any preceding embodiment, wherein the water is present in an amount of about 25 to about 45 weight percent, based on the total weight of the aqueous liquid detergent.

Embodiment 16: A method of preparing a shear-thinning, non-thixotropic aqueous liquid detergent comprising: mixing one or more surfactants and a chloride salt in an aqueous liquid medium to form a first mixture; and adding a builder comprising potassium carbonate to the first mixture to form the aqueous liquid detergent as a substantially homogeneous solution; wherein said substantially homogeneous solution forms without the intermediate formation of a gel phase.

Embodiment 17: A method of preparing a detergent article comprising: mixing one or more surfactants and a chloride salt in an aqueous liquid medium to form a first mixture; adding a builder comprising potassium carbonate to the first mixture to form an aqueous liquid detergent as a substantially homogeneous solution; placing a measured amount of the aqueous liquid detergent into a package for the aqueous liquid detergent which is in direct contact with the aqueous liquid detergent, wherein the package is formed from a water-soluble, film-forming material, and wherein the film-forming material is insoluble with respect to the aqueous liquid detergent contained within the package; and heat sealing the water-soluble, film forming material of the package.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

Other aspects and advantages of the present invention will become apparent from the following.

BRIEF DESCRIPTION OF THE DRAWINGS

FIG. 1 is a plot of log shear rate vs. log viscosity of slurry formulations with and without potassium chloride.

DETAILED DESCRIPTION OF THE INVENTION

The present disclosure now will be described more fully hereinafter with reference to the accompanying drawings. The disclosure may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural references unless the context clearly dictates otherwise.

In one aspect of the present invention, an article is provided, the article for use in the laundry process comprising an aqueous liquid detergent and a package for the aqueous liquid detergent. More particularly, the article is an aqueous, organic solvent free, liquid laundry detergent contained in a package, preferably a pouch or packet, containing a unit dose of the liquid laundry detergent, the package comprising a water soluble film-forming material that dissolves when placed in the laundry wash water so as to release the liquid laundry detergent. As used herein, terms such as "package", "pod", "pouch", and the like can be used interchangeably to describe the water-soluble film forming the article enclosing liquid laundry detergents described herein. According to the invention, the water-soluble film-forming material is in substantially direct contact with the liquid laundry detergent, with the film-forming material maintaining its structural integrity prior to external contact with an aqueous medium, such as a laundry wash liquor. The liquid detergent is capable of remaining homogeneous over a relatively wide temperature range, such as might be encountered in storage, and the pouch is capable of dissolution in water even after extended storage.

The water-soluble package of this invention can preferably be made from polyvinyl alcohol, but can also be cast from other water-soluble materials such as polyethylene oxide, methyl cellulose and mixtures thereof. Suitable water-soluble films are well known in the art and are commercially available from numerous sources.

The liquid laundry detergent package itself can be of any configuration, but conveniently may have a rectangular or square shape when viewed normally to the plane of its two longest dimensions. A rectangular or square packet is more easily manufactured and sealed than other configurations when using conventional packaging equipment.

The liquid laundry detergent for use in this invention is formulated in a manner which makes it compatible with the water-soluble film for purposes of packing, shipping, storage, and use. Without being limited by theory, compatibility of the liquid laundry detergent with the water-soluble film can be achieved by the use of an appropriate salt in the liquid laundry detergent composition. The liquid laundry detergent is a concentrated, heavy-duty liquid detergent which can contain at least about 25 weight percent of water, based on the weight of the overall detergent composition. In some embodiments, water can be present in an amount of about 25 weight percent to about 50 weight percent, about 25 weight percent to about 45 weight percent, about 30 weight percent to about 40 weight percent, or about 30 weight percent to about 35 weight percent, based on the total weight of the detergent composition.

As described herein, embodiments of the invention relate to an aqueous liquid detergent, which can be encapsulated in a water-soluble package. In particular, various embodiments of the present invention relate to an aqueous liquid detergent comprising a water-soluble alkaline carbonate builder, and a chloride salt. The formulations are essentially homogenous (show substantially no phase separation) for an extended time period and temperature range. They are not clear transparent liquids, but are rather turbid and similar in form to pastes or gels. While homogeneity of the formulations provides a desirable product appearance, phase separation can also be a product performance issue, since both phases in a phase-separated system may not disperse and dissolve rapidly during the wash cycle, although the formulation may have dispersed and dissolved rapidly before phase separation occurred.

The water-soluble alkaline carbonate builder in the detergent composition can comprise, for example, an alkali metal carbonate, bicarbonate, or sesquicarbonate (preferably sodium or potassium carbonate, bicarbonate, or sesquicarbonate), or mixtures thereof. In certain embodiments, the builder comprises potassium carbonate. The presence of the builder in the formulation renders the aqueous liquid detergent non-solubilizing relative to the water-soluble pouch (made from, for example, polyvinyl alcohol and/or polyvinyl acetate). As such, the presence of the builder results in compatibility between the pouch and the formulation by preventing the aqueous detergent from dissolving the water-soluble package the aqueous detergent is stored within. The builder (e.g., potassium carbonate) also allows for the detergent composition to comprise a higher water content than the water content of many conventional detergent packages. The high water content of the formulations of the present invention, in addition to allowing rapid dispersion and dissolution in the wash cycle, can result in a significant cost reduction, thereby making a pouch-type detergent available to the consumer at a significantly lower price.

The aqueous liquid detergents of the present invention can comprise a builder in an amount of about 15% to about 50% by weight, about 20% to about 40% by weight, or about 25% to about 35% by weight, based on the total weight of the aqueous liquid detergent. In certain embodiments, the detergent composition can comprise a builder in an amount of at least about 15% by weight, at least about 25% by weight, or at least about 30% by weight, based on the total weight of the aqueous liquid detergent.

The presence of the builder in the detergent composition can render the composition susceptible to phase changes and separations before the composition reaches its final paste/slurry (homogeneous) form. For example, a formula comprising only potassium carbonate (i.e., no chloride salt) goes through a gel phase and then complete separation before reaching a final paste/slurry form. By adding a chloride salt to the detergent composition, the gel formation is eliminated and the phase separation is reduced, thereby easing the mixing/preparation process of detergent compositions according to the present invention. As such, embodiments of the aqueous detergent composition further comprise a chloride salt. Without being limited by theory, the chloride salt can help prevent and/or reduce the phase changes and separations caused by the builder in the detergent composition. In some embodiments, the chloride salt can comprise potassium chloride, sodium chloride, or combinations thereof. In certain embodiments, the chloride salt can be potassium chloride.

In various embodiments, the chloride salt can be present in the detergent composition in an amount of about 0.1% to about 5% by weight, or about 1% to about 3% by weight, based on the total weight of the aqueous liquid detergent. In certain embodiments, the detergent composition can comprise a chloride salt in an amount of at least about 0.1% by weight, at least about 1% by weight, or at least about 3% by weight, based on the total weight of the aqueous liquid detergent.

The builder and the chloride salt can be present in the detergent composition in a combined total amount of about 25% to about 50% percent by weight, about 30% to about 40% by weight, or about 30% to about 38% by weight, based on the total weight of the aqueous liquid detergent. In certain embodiments, the builder and the chloride salt can be present in the detergent composition in a combined total amount of about 30% to about 34% by weight, based on the total weight of the aqueous liquid detergent.

In various embodiments of the invention, the builder and the chloride salt can be present in the detergent composition in a weight ratio of about 99:1 to about 75:25, or about 98:2 to about 85:15. In certain embodiments, the builder and the chloride salt can be present in the detergent composition in a weight ratio of about 90:10.

Some embodiments of the aqueous liquid detergent compositions of the present invention can further comprise a surfactant. For example, the detergent compositions can comprise a nonionic surfactant, an anionic surfactant, or combinations thereof. In some embodiments, it can be advantageous for a nonionic surfactant to be present in an amount of at least 50% by weight based on the total weight of surfactant employed. As is understood by those skilled in the art, nonionic surfactants lower the critical micelle concentration, and achieve superior oil removal. This ratio of 50% nonionic surfactant to total surfactant present can also act to minimize phase separation within the pouch, as well as to enhance detergency, particularly in hard water. In certain embodiments, the composition can comprise at least one surfactant selected from the group consisting of 12-15 carbon alcohol ethoxylate with 7 moles ethylene oxide per mole of alcohol (e.g., Neodol 25-7 and other similar products available from Shell Global), 12-carbon alkylbenzene sulfonic acid neutralized with monoethanolamine, and sodium laureth sulfate having 2-5 moles ethylene oxide (e.g., Steol® products available from Stepan Company).

In various embodiments of the present invention, the aqueous liquid detergent can be shear-thinning (i.e., as the shear rate increases in a steady shear flow, the viscosity decreases). In certain embodiments, the aqueous liquid detergent can be non-thixotropic. As is known in the art, thixotropy is a time-dependent shear thinning property. Certain gels or fluids that are thick/viscous under static conditions will become thin/less viscous over time when shaken, agitated, sheared, or otherwise stressed (i.e., time dependent viscosity). A thixotropic fluid is a fluid which takes a finite time to attain equilibrium viscosity when introduced to a steep change in shear rate. As such, a thixotropic fluid which demonstrates a decrease in the apparent viscosity under constant shear stress or shear rate, will gradually recover its starting viscosity when the stress or shear rate is removed. By contrast, a non-thixotropic fluid will immediately recover its starting viscosity when the stress or shear rate is removed (i.e., the viscosity effect is not time dependent). See, e.g., *An Introduction to Rheology* by H. A. Barnes, J. F. Hutton, and K. Walters, 1989, Elsevier Science Rheology Series Volume 3, pages 166 and 168, which is herein incorporated by reference in its entirety. The rheology properties (shear-thinning and non-thixotropic) can be important defining features of embodiments of the aqueous liquid detergent compositions described herein. The combination of ingredients and the order of addition disclosed herein can led to a structured composition that exhibits a specific flow behavior when subjected to a given stress or at increasing/decreasing shear rates. In addition, without being limited by theory, the presence of potassium chloride can result in a different flow behavior (viscosity decreased faster with increasing shear rates) as compared to its absence in the formulation. For example, the rheology data shown in Example 5 below provides experimental observation that adding potassium chloride resulted in improved ease of mixing of the formulation, which is important in the processing (large scale mixing/stirring/pipe flow) of the laundry detergent formulation.

A method of preparing an aqueous liquid detergent is also provided herein. In various embodiments, the method of preparing the detergent composition can comprise mixing one or more surfactants and a chloride salt in an aqueous liquid medium to form a first mixture and adding a builder comprising potassium carbonate to the first mixture to form the aqueous liquid detergent as a substantially homogeneous solution. As noted above, the substantially homogeneous solution forms without the intermediate formation of a gel phase due in part to the incorporation of the chloride salt. It was also surprisingly discovered that the order of addition of the components of the detergent composition can further contributed to an increase in the ease of mixing and a decrease in undesirable phase changes and separations. Adding the chloride salt early in the mixing process can be desirable.

In some embodiments, a method of preparing an aqueous liquid detergent comprises first pre-mixing the surfactant such as Steol® with water. Then amine or diamine can be added as a base neutralizer. Next, dodecyl benzene sulfonic acid (DBSA) can be added to the mixture. A potassium salt can then be added to the mixture, followed by the addition of Neodol 25-7, which can help eliminate the gel phase. Next, a builder (e.g., potassium carbonate) in solid form can be added to the mixture. The mixture can then be mixed at a high speed of mixing to create a paste/slurry.

In some embodiments, the method of preparing an aqueous liquid detergent can further include preparing a detergent article by placing a measured amount of the aqueous liquid detergent into a package for the aqueous liquid detergent. As discussed in more detail above, the package can be in direct contact with the aqueous liquid detergent. Furthermore, the package can be formed from a water-soluble, film-forming material, however, the film-forming material is insoluble with respect to the aqueous liquid detergent contained within the package. After placing a measured amount of the aqueous liquid detergent into the package, the water-soluble, film forming material of the package can be heat sealed in order to close the detergent within the package.

EXPERIMENTAL

Example 1

Six different builder/salt combinations were tested to determine stability of the composition and final consistency. The combinations tested were: 1) only potassium carbonate; 2) potassium carbonate and sodium carbonate; 3) potassium carbonate and sodium chloride; 4) sodium carbonate and potassium chloride; 5) potassium carbonate and potassium chloride; 6) potassium carbonate and potassium chloride and sodium chloride.

Each sample was prepared by first adding glycerin in water, followed by an anionic surfactant (alkyl ether sulfate), manoethanolamine, brightener, polymer, another anionic surfactant (alkylbenzenesulfonic acid), and a nonionic surfactant. If included, one or more chloride salts was also added at this stage. After all of the surfactants were added, the batch was mixed and it thickened up. One or more builders were then added and the batch was mixed thoroughly. The final product was a white milky paste/slurry. The final mixture was then placed in a pod by heat-sealing MonoSol® 8310 polyvinylalcohol (PVOH) film (available from MonoSol LLC in Merrillville, Ind.).

Stability of each sample pod was graded at different temperatures. For a 60° C. test, a pod of each detergent composition underwent 7 cycles, each cycle being approximately 16 hours at 60° C. followed by approximately 8 hours at room temperature. After each cycle, the formula in each pod was checked for changes in consistency/flow, color, phase, and appearance. The film was checked for firmness, leakage, drying, and sweating. Each sample was then graded after each cycle on a stability scale from 1-6 (1=no failure, 2=oily phase/water phase and mixed in, 3=drying the film/leaking/dry material on the film, 4=drying the film and oily/discoloration, or grainy, drying, discoloration and clumpy and separation, 5=grainy and clumpy and separation, 6=sweating of film/film getting softer, 7=complete failure). The term "stable formula" is used to designate a formula that has not undergone any changes in aesthetics, consistency, and phase. The term "stable film" is used to designate a film that has not undergone any changes in firmness, texture, flexibility, and moisture.

A pod of each detergent composition underwent a cycle at 50° C., wherein each sample sat in a chamber held at 50° C. for three months. At the end of the three month cycle, each sample was checked for changes in consistency/flow, color, phase, and appearance. The film was checked for firmness, leakage, drying, and sweating. Each sample was then was then graded on a stability scale from 1-7 (1=no failure, 2=oily phase/water phase and mixed in, 3=drying the film/leaking/dry material on the film, 4=grainy and clumpy and separation, 5=sweating of film/film getting softer, 6=complete failure).

A pod of each detergent composition underwent 5 freeze/thaw cycles, wherein for each cycle, each sample was held at freezing temperature for approximately 16 hours followed by approximately 8 hours at room temperature. After each cycle, the formula in each pod was checked for changes in consistency/flow, color, phase, and appearance. The film was checked for firmness, leakage, drying, and sweating. Each sample was then graded on a pass/fail basis. A pod of each detergent composition underwent a two month cycle at 4° C. and was then graded on a pass/fail basis. A pod of each detergent composition underwent a two month cycle at room temperature and was then graded on a pass/fail basis.

Table 1 below provides a summary of the different builder/salt combinations that were tested for stability.

TABLE 1

Summary of Builder/Salt Combinations

| Builder/Salt Combination | Ratio of Builder:Salt (wt. %) | Total Amt. of Builder + Salt in the Formula (wt. %) | Total Amt. of Surfactant in the Formula (wt. %) | Comments |
|---|---|---|---|---|
| Combination 1: Potassium Carbonate | — | 26%-33% | 17.45%-19.45% | 26%-32% failed. Finished product was clumpy Only 33% passed. |
| Combination 2: Potassium Carbonate. Sodium Carbonate | 50:50 | 33% | 17.45%-19.45% | Failed-Phase separation |
| | 75:25 | 33% | 17.45%-19.45% | Failed-Phase separation |
| Combination 3: Potassium Carbonate: Sodium Chloride | 50:50 | 33% | 17.45%-19.45% | Failed-Particles in formula, not completely homogeneous |
| | 75:25 | 31.35%-33% | 17.45%-19.45% | Failed-Phase separation |
| | 80:20 | 31.35%-33% | 17.45%-19.45% | Failed-Phase separation |
| | 90:10 | 20%-36% | 17.45%-19.45% | 20%-30% failed (all clumpy). 36% failed (phase separation). 32%-34% passed. Overall builder needs to be higher than 30%, but not more than 34%. |

TABLE 1-continued

Summary of Builder/Salt Combinations

| Builder/Salt Combination | Ratio of Builder:Salt (wt. %) | Total Amt. of Builder + Salt in the Formula (wt. %) | Total Amt. of Surfactant in the Formula (wt. %) | Comments |
|---|---|---|---|---|
| Combination 4: Sodium Carbonate: Potassium Chloride | 75:25 | 24.3%-29.5% | 17.45%-19.45% | Failed-Clumpy and grainy |
| | 90:10 | 24.3%-26.96% | 17.45%-19.45% | Failed-Clumpy and grainy |
| | 64:36 | 30%-40% | 17.45%-19.45% | Failed-Phase separation |
| Combination 5: Potassium Carbonate: Potassium Chloride | 75:25 | 20%-36% | 17.45%-19.45% | 20%-30% failed (all clumpy). 36% failed (phase separation). 32%-34% passed. Overall builder needs to be higher than 30%, but not more than 34%. |
| | 80:20 | 26%-38% | 17.45%-19.45% | 26%-30% failed (all clumpy). 36%-38% failed (phase separation). 32%-34% passed. Overall builder needs to be higher than 30%, but not more than 34%. |
| | 90:10 | 20%-40% | 17.45%-19.45% | 20%-28% failed (clumpy). 40% failed (phase separation). 30%-38% passed. |
| Combination 6: Potassium Carbonate, Potassium Chloride, Sodium Chloride | — | Potassium Carbonate = 20%-50% Potassium Chloride = 0-10% Sodium Chloride = 0-10% | 17.45%-19.45% | This set of experiments showed failure in terms of phase separation, clumpy or grainy batches for sodium chloride added. The design space indicated failure due to the addition of sodium chloride. |
| * Combination 5 additional experiment: Potassium Carbonate: Potassium Chloride | — | Potassium Carbonate = 20%-55% Potassium Chloride = 0-15% Water = 30-65% | 15%-30% | This set of experiments suggested that if you increase the water level, it is beneficial to balance out with combination of potassium carbonate and surfactant, but potassium chloride level needs to be lower (≤5 wt. %). On the other hand, for a low level of water (e.g., 30 wt. %), most of the good results were found for higher levels of surfactant |

Combination 1 (only potassium carbonate) was tested at different levels resulting in 10 different sets of formula. Out of all 10 batches, only one batch passed film stability. All other batches failed initial screening because due to the mixture being too clumpy, phase separation, heating required during preparation of the batch, etc.

Combination 2 (potassium carbonate and sodium carbonate) was tested at different ratios (50:50 and 75:25) and phase separation was observed upon the addition of sodium carbonate for all samples.

Combination 3 (potassium carbonate and sodium chloride) was tested at different ratios of builder to chloride salt (50:50, 75:25, 80:20, and 90:10). Samples of 50:50, 75:25, and 80:20 ratios had phase separation, were grainy, or required heating of the batch in order for mixing to be properly achieved. Samples of 90:10 ratios were smooth homogeneous mixtures if the overall weight percent of the potassium carbonate and sodium chloride in the detergent composition was about 30% by weight or higher, based on the total weight of the detergent composition. In addition, PVOH pod stability failed at higher temperatures (i.e., the 50° C. and 60° C. cycles).

Combination 4 (sodium carbonate and potassium chloride) was tested at different ratios of builder to chloride salt (64:36, 75:25, and 90:10). Samples of all the ratios tested failed PVOH pod stability at room temperature, 4° C. freeze/thaw cycles, and at higher temperatures (i.e., the 50° C. and 60° C. cycles).

Combination 5 (potassium carbonate and potassium chloride) was tested at different ratios of builder to chloride salt (75:25, 80:20, and 90:10). Samples of 75:25 and 80:20 ratios were smooth homogeneous mixtures if the overall weight percent of the potassium carbonate and potassium chloride in the detergent composition was about 30% by weight to about 34% by weight, based on the total weight of the detergent composition. Samples of 90:10 ratios were smooth homogeneous mixtures if the overall weight percent of the potassium carbonate and potassium chloride in the detergent composition was about 30% by weight to about 38% by weight, based on the total weight of the detergent composition. Samples of the 90:10 ratios had more salt tolerance and were considered to be more robust than samples of other ratios due to the fact that PVOH pod stability for samples of the other ratios failed for later high temperature cycles.

Overall, samples of all the ratios tested showed good or at least improved PVOH pod stability at room temperature, 4° C. freeze/thaw cycles, and at higher temperatures (i.e., the 50° C. and 60° C. cycles), with samples of the 90:10 ratios exhibiting the best stability results.

Combination 6 (potassium carbonate and potassium chloride and sodium chloride) was tested at different ratios of builder to chloride salt. Each of the samples exhibited failure in terms of phase separation, dumpiness or graininess once sodium chloride was added to the batch.

Based on the evaluation of the various samples, it was discovered that the stability of the detergent composition can be improved by choosing the correct level of potassium chloride in the composition. Observation of samples of the 6 combinations described above showed that detergent compositions comprising only a builder (e.g., potassium carbonate) go through different phases before becoming the final paste/slurry (homogenous form). The builder-only compositions (e.g., combination 1) go to a gel phase, then undergo complete phase separation, and then reach the final paste/slurry form. By adding a chloride salt (e.g., potassium chloride) to the formula, the gel formation is eliminated and the phase separation is reduced. As such, there is an ease of mixing the formula.

Example 2

Combination 5 (potassium carbonate and potassium chloride) from Example 1 above was further analyzed to determine the effect of varying levels of surfactant in the composition, as well as the effect of varying levels of builder and salt in the detergent composition.

A set of experiments was conducted where the potassium carbonate was varied from about 20-55 weight percent, based on the total weight of the detergent composition, the potassium chloride was varied from about 0-15 weight percent, based on the total weight of the detergent composition, the amount of water was varied from about 30-65 weight percent, based on the total weight of the detergent composition, and the amount of surfactant was varied from about 15-30 weight percent, based on the total weight of the detergent composition.

It was discovered that for an increased water level (e.g., above 30 weight percent), the amount of potassium chloride needs to be lower (e.g., less than or equal to 5 weight percent). It was also discovered that for a lower level of water (e.g., about 30 weight percent), most of the good results were achieved where there was a high level of surfactant (e.g., about 20 weight percent).

Samples of combination 5 were also compared to samples of combination 1 from Example 1 (only potassium carbonate) to determine the effect of aging on the pod samples. It was discovered that, when aged for the same time, pod samples of combination 1 started getting thicker faster than pod samples of combination 5. A composition that thickens more slowly can be easier to prepare and also transfer into molds to make the PVOH pods.

Example 3

Unit dose samples of a laundry detergent formulation comprising potassium carbonate and potassium chloride were prepared and tested for stability, as described in Example 1 above.

Each sample was prepared by first adding glycerin in water, followed by an anionic surfactant (alkyl ether sulfate), potassium chloride, manoethanolamine, brightener, polymer, another anionic surfactant (alkylbenzenesulfonic acid), and a nonionic surfactant. The composition was then mixed and it thickened up. Potassium carbonate was then added and the batch was mixed thoroughly. When the potassium carbonate was added, the batch underwent a phase separation, but there was no gel formation. The batch then reached a final homogeneous solution. The final product was a white milky paste/slurry. The final mixture was then placed in a pod by heat-sealing MonoSol® 8310 polyvinylalcohol (PVOH) film (available from MonoSol LLC in Merrillville, Ind.). Table 1 below lists the weight percentages of the detergent composition. The order of addition of the ingredients was from top to bottom of Table 2.

TABLE 2

Unit Dose of Laundry Detergent Formulation Comprising Potassium Carbonate and Potassium Chloride

| Ingredient | Weight % |
|---|---|
| Water | 36.925 |
| Glycerine | 5 |
| Steol 25-3S/70FC | 9.271 |
| Potassium Chloride | 1 |
| Monoethanolamine (MEA) | 0.41 |
| Brightener CBS SP 33% | 0.68 |
| R&H Polymer 445 (49%) | 1.24 |
| Biosoft S-118 | 1.418 |
| Neodo 25-7 | 12.056 |
| Potassium Carbonate | 32 |
| Totals | 100 |

Sample pods of the detergent composition listed in Table 1 underwent stability testing at 60° C. (7 cycles), 50° C., 4° C. and room temperature (for 2 months), and freeze/thaw cycles (5 cycles). The product was stable in the PVOH film for all of the tested conditions.

Example 4

Samples of laundry detergent slurries comprising potassium carbonate and potassium chloride were prepared as described in Example 1 above and tested for flow properties.

Rheology analysis was performed using the following equipment and measurement conditions. ATS Rheosystems ViscoAnalyzer REOLOGICA InstrumentsAB, constant rate (stepwise), cup and bob (CC25), viscosity measurements at 20° C. at increasing and decreasing shear rates and at 20-sec intervals. Table 3 below shows the viscosity data at increasing and decreasing shear rate.

TABLE 3

Viscosity Data at Increasing and Decreasing Shear Rate

| Shear rate | Log shear rate | Viscosity (Pas) Slurry |
|---|---|---|
| 0.1 | −1 | 137.3 |
| 1 | 0 | 31.13 |
| 10 | 1 | 8.875 |
| 100 | 2 | 3.285 |
| 114.1 | 2.06 | 3.079 |
| 100 | 2 | 3.203 |
| 10 | 1 | 8.917 |
| 1 | 0 | 31.91 |
| 0.1 | −1 | 139.9 |

Based on the rheology analysis, the slurry formulation was found to be shear thinning as it was shown that the viscosity decreased with increasing shear rate. In addition, the slurry formulation was shown to be non-thixotropic within the time interval studied.

Example 5

Samples of laundry detergent slurries comprising potassium chloride and slurries substantially free of potassium chloride were prepared as described in Example 1 above and tested for flow properties.

Rheology analysis was performed using the following equipment and measurement conditions. ATS Rheosystems ViscoAnalyzer REOLOGICA InstrumentsAB, shear rate sweep, P40 serrated Gap 1.000 mm, equilibrium time 25.0 seconds, shear rates $10^1$-$10^2$ $s^{-1}$ (typical shear rates for mixing, stirring, and pipe flow). See, e.g., H. A. Barnes et al., *An Introduction to Rheology*. Vol. 3. 1989. Elsevier; which is herein incorporated by reference in its entirety.

The Power Law Model equation was used to describe the non-Newtonian flow property of the slurry formulation.

$$\eta = K_2 \hat{\gamma}^{n-1}$$ Power Law Model Equation:

In this equation, there is a direct correlation between viscosity and shear rate, and the slope $K_2$ of the equation is called "consistency." In the plot of log shear rate vs log viscosity (FIG. 1), the slope of the slurry formulation with KCl is different from the slope of the slurry formulation without KCl. Without being limited by theory, this difference in slopes or "consistency" seems to be due to the effect of potassium chloride on the flow property of the slurry formulation. In the presence of potassium chloride, the viscosity of the slurry formulation decreases faster with increasing shear rate, as shown in FIG. 1, the line with the steeper slope. This rheological difference may explain the observation that adding potassium chloride resulted in a more flowable, easier to mix formulation. This may be advantageous in the processing of the slurry formulation, easing the mixing, stirring and pipe flow processes.

Many modifications and other embodiments of the disclosure will come to mind to one skilled in the art to which this disclosure pertains having the benefit of the teachings presented in the foregoing description; and it will be apparent to those skilled in the art that variations and modifications of the present disclosure can be made without departing from the scope or spirit of the disclosure. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An article comprising:

a shear-thinning, non-thixotropic aqueous liquid detergent comprising:

at least about 25% by weight of water based on the total weight of the aqueous liquid detergent;

from 15% by weight to 30% by weight of surfactant based on the total weight of the aqueous liquid detergent;

a builder comprising potassium carbonate; and potassium chloride salt;

wherein the potassium carbonate and the potassium chloride are present in a combined total amount of about 30% to about 38% percent by weight based on the total weight of the aqueous liquid detergent, and the potassium carbonate and the potassium chloride are present in a weight ratio of about 99:1 to about 75:25; and a package for the aqueous liquid detergent which is in direct contact with the aqueous liquid detergent, wherein the package is formed from a water-soluble, film-forming material.

2. The article of claim 1, wherein the surfactant comprises an anionic surfactant and a nonionic surfactant.

3. The article of claim 1, wherein the water-soluble film-forming material is polyvinyl alcohol.

4. The article of claim 1, wherein the potassium carbonate and the potassium chloride are present in a weight ratio of about 98:2 to about 85:15.

5. The article of claim 1, wherein the potassium chloride is present in an amount of about 0.1% to about 5% by weight based on the total weight of the aqueous liquid detergent.

6. The article of claim 1, wherein the water is present in an amount of about 25 to about 45 weight percent, based on the total weight of the aqueous liquid detergent.

* * * * *